US005174376A

United States Patent [19]

Singeetham

[11] Patent Number: 5,174,376

[45] Date of Patent: Dec. 29, 1992

[54] METAL-TO-METAL ANNULUS PACKOFF FOR A SUBSEA WELLHEAD SYSTEM

[75] Inventor: Shiva P. Singeetham, Houston, Tex.

[73] Assignee: FMC Corporation, Chicago, Ill.

[21] Appl. No.: 633,631

[22] Filed: Dec. 21, 1990

[51] Int. Cl.[5] ..... E21B 33/04

[52] U.S. Cl. ..... 166/208; 166/182; 166/217; 166/348; 285/348

[58] Field of Search ..... 166/182, 208, 217, 115, 166/348; 285/348

[56] References Cited

U.S. PATENT DOCUMENTS

| | | | |
|---|---|---|---|
| 2,692,066 | 10/1954 | Conrad | 220/55.3 |
| 4,030,544 | 6/1977 | Ahlstone | 166/182 |
| 4,178,020 | 12/1979 | Dopyera | 285/18 |
| 4,209,270 | 6/1980 | Billingsley | 405/195 |
| 4,408,783 | 10/1983 | Gruller | 285/3 |
| 4,665,979 | 5/1987 | Boehm, Jr. | 166/208 |
| 4,719,971 | 1/1988 | Owens | 166/191 |
| 4,742,874 | 5/1988 | Gullion | 166/348 |
| 4,750,559 | 6/1988 | Greenlee et al. | 166/216 |
| 4,751,965 | 6/1988 | Cassity | 166/182 |
| 4,757,860 | 7/1988 | Reimert | 166/208 |
| 4,766,956 | 8/1988 | Smith et al. | 166/182 |
| 4,771,832 | 9/1988 | Bridges | 166/380 |
| 4,791,987 | 12/1988 | Cassity et al. | 166/85 |
| 4,823,871 | 4/1989 | McEver et al. | 166/208 X |
| 4,832,125 | 5/1989 | Taylor | 166/348 |
| 4,900,041 | 2/1990 | Hopkins et al. | 277/30 |
| 4,932,472 | 6/1990 | Boehm, Jr. | 166/208 |
| 4,949,786 | 8/1990 | Eckert et al. | 166/208 |
| 4,949,787 | 8/1990 | Brammer et al. | 166/217 X |
| 4,960,172 | 10/1990 | Nelson | 166/217 X |
| 5,025,864 | 6/1991 | Nobilean | 166/348 |

FOREIGN PATENT DOCUMENTS 2176547 12/1986 United Kingdom .

*Primary Examiner*—Hoang C. Dang

[57] ABSTRACT

An all-metal, well annulus packoff assembly for establishing a high pressure, corrosion resistant metal-to-metal seal between a wellhead housing and a casing hanger, including an annular metallic seal element having a generally upstanding U-shaped cross section that is adapted for non-rotational sequential setting against the hanger and the housing.

10 Claims, 2 Drawing Sheets

METAL-TO-METAL ANNULUS PACKOFF FOR A SUBSEA WELLHEAD SYSTEM

BACKGROUND OF THE INVENTION

This invention relates to seals for use with well drilling and completion equipment, and more particularly to packoffs for providing metal-to-metal seals between a subsea wellhead housing and a casing hanger.

In the oil and gas industry, and especially in subsea or other underwater well drilling procedures, it is well established practice to employ an annular seal assembly, referred to as a packoff, between adjacent concentric wellhead elements, such as the wellhead housing and casing hangers that support the casing strings in the well, to pressure seal the annuli between these elements. For many years these packoffs have included elastomeric or other non-metallic annular seal elements that, when energized into tight contact with the opposed wellhead and hanger surfaces, provided the requisite pressure barrier. However, the increasing trend towards drilling deep wells into relatively high pressure strata, and the frequency of encountering hydrogen sulfide or other corrosive gases in these wells, has led to development of packoffs with all metal seal elements to establish a metal-to-metal pressure barrier. Although some of the known packoffs with metal-to-metal seals function satisfactorily under certain conditions, there is a growing industry need for such packoffs that can be installed from a remote location without difficulty, that will withstand higher operating pressure and higher corrosive environments than heretofore experienced, and that will maintain the seal throughout wide fluctuations in pressure.

SUMMARY OF THE INVENTION

Broadly considered, the present invention comprises an improved all-metal annulus packoff assembly for establishing a high pressure, corrosion resistant metallic seal in between an internal cylindrical surface of a wellhead housing and an external tapered surface of a casing hanger concentrically positioned in the housing, and for maintaining that seal in the presence of high temperatures and highly corrosive environments. The packoff assembly comprises an annular seal element that is set by weight or hydraulic pressure, and that has a unique cross-sectional configuration that is energized into fluid-tight contact with the housing and hanger by an annular energizing mandrel also of novel configuration. The packoff also includes shear pins releasably interconnecting the seal element and the energizing mandrel in the element's unenergized condition, a seal element retrieval ring for maintaining a connection between the seal element and the mandrel during retrieval of the packoff, a hanger lockdown ring for locking the packoff in energized condition to the hanger, an annular locking mandrel for moving the hanger lockdown ring into its locking position, and a packoff retrieval ring for maintaining a connection between the energizing mandrel and the locking mandrel to facilitate retrieval of the packoff.

If it is desired to lock the packoff to the wellhead housing, the invention also provides for an optional wellhead lockdown ring on the packoff assembly, and means to move the ring into locking position in the housing.

The packoff seal element includes an annular base, an axially-extending inner tubular portion, and an outer annular lip portion extending in the same axial direction, the seal element thereby having a generally U-shaped cross-sectional configuration with an annular cavity open at its upper end. The inner surfaces of the base and adjacent tubular portion form a frusto-conical inner seal surface that tapers upwardly and inwardly, and on this frusto-conical surface are a plurality, preferably three, of annular inner sealing ridges of radiused cross-section that establish a metal-to-metal seal with the complementary tapered frusto-conical external surface of the casing hanger. The outer lip portion of the seal element extends upwardly and outwardly from the seal base and carries a plurality, preferably two, of annular outer sealing ridges also of radiused cross-section that establish a metal-to-metal seal with the cylindrical sealing surface of the wellhead housing. The outer surface of the seal element tubular portion is cylindrical, whereas the inner surface of the lip portion tapers upwardly and outwardly in a frusto-conical manner.

The seal element energizing mandrel has a lower end portion with a cylindrical inner surface and a frusto-conical outer surface that tapers upward and outward at an angle greater than that of the inner frusto-conical surface of the seal element base and its tubular portion. As it descends into the annular space between the seal element lip and tubular portion the energizing mandrel forces the seal lip into metal-to-metal sealing engagement with the wellhead housing and also applies additional squeeze on the seal element's inner sealing ridges which have previously moved into sealing contact with the hanger sealing surface. This effects sequential energization of the seal element sufficient to establish and maintain the requisite metal-to-metal seal between the housing and the hanger, even in the presence of well pressure beneath the seal.

DESCRIPTION OF THE PREFERRED EMBODIMENT

Figure 1:
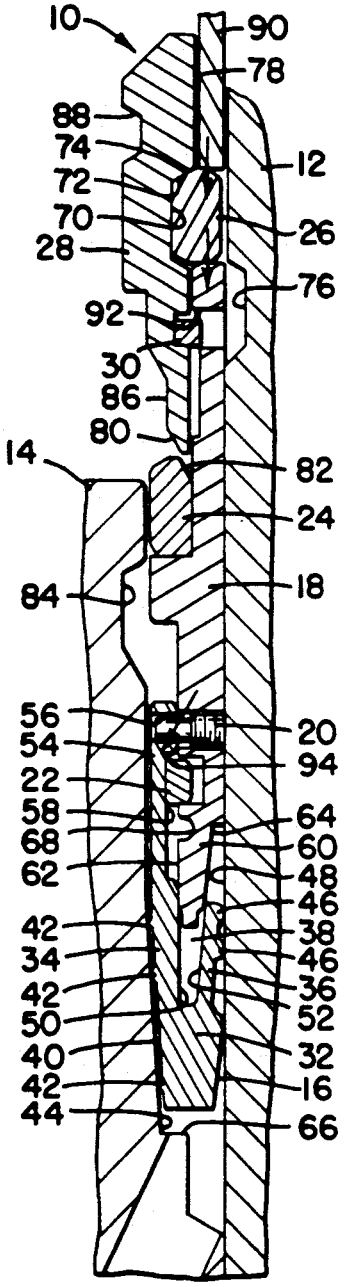
FIG. 1 is a fragmentary view in vertical section of a packoff assembly according to the present invention, showing the assembly in its initial installation position between a wellhead housing and a casing hanger wherein the seal element has just landed on the frusto-conical sealing surface of the hanger.
Figure 2:
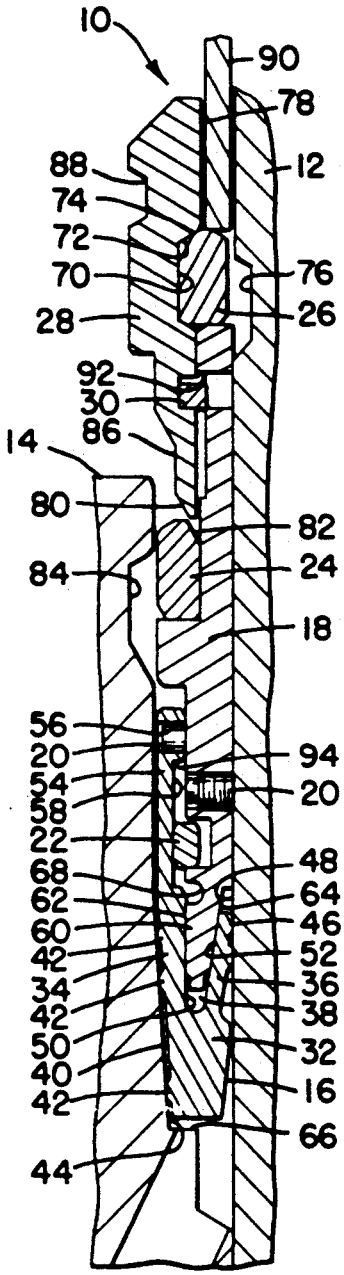
FIG. 2 is a view like and subsequent to FIG. 1, showing the position of the assembly elements after the shear pins have been sheared by imposition of the running string weight on the energizing mandrel, and that mandrel partially descended into the annular cavity of the seal element.
Figure 3:
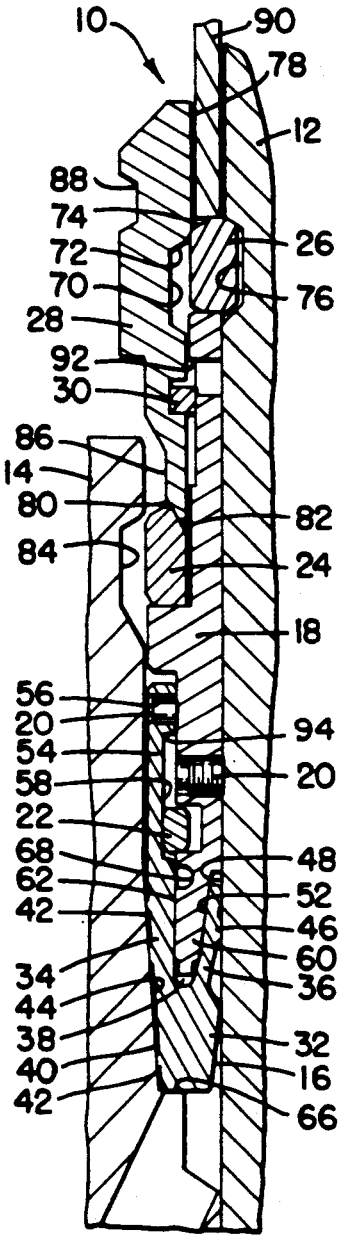
FIG. 3 is a view like and subsequent to FIG. 2, showing the seal element landed on an annular upward-facing shoulder on the hanger, the energizing mandrel further descended into the seal element cavity, and the wellhead lockdown ring expanded into its functional position in the wellhead housing.
Figure 4:
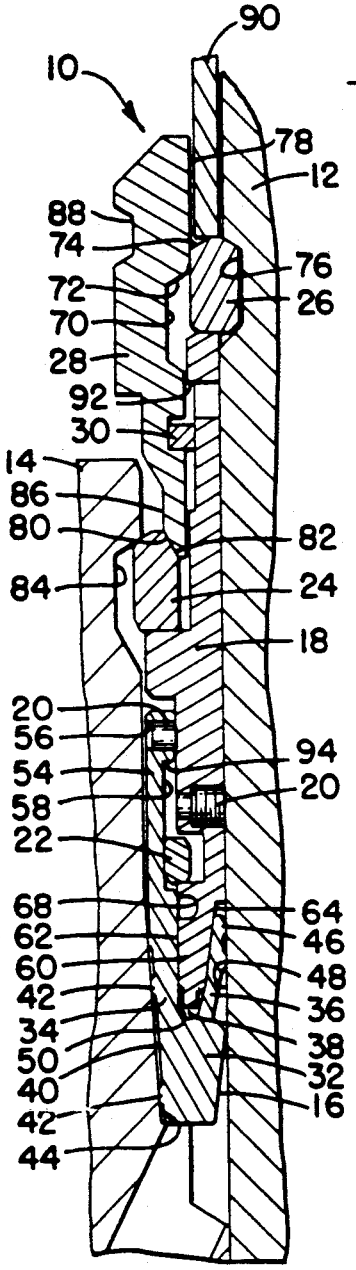
FIG. 4 is a view like and subsequent to FIG. 3, showing the locking mandrel partially descended behind the wellhead lockdown ring and the hanger lockdown ring partially contracted into its cooperating groove in the hanger.

As seen in FIGS. 1-5, which sequentially illustrate the various stages of running and setting a packoff assembly 10 into fully functional position between a wellhead housing 12 and a casing hanger 14, the packoff assembly 10 comprises an annular metallic seal element 16 for establishing a metal-to-metal seal between the housing 12 and hanger 14, a sleeve-like energizing mandrel 18 for energizing the seal element 16 into that metal-to-metal sealing condition, a plurality (only one shown) of circumferentially spaced shear pins 20 releasably securing the seal element 16 and its energizing mandrel 18 together, a seal element retrieval ring 22 for retaining the seal element 16 on the mandrel 18 in the event retrieval of the seal element is desired, a split and outwardly biased hanger lockdown ring 24 for locking the packoff 10 to the hanger 14, a split and inwardly biased wellhead lockdown ring 26 for locking the packoff to the wellhead housing 12, a sleeve-like locking mandrel 28 for moving the rings 24, 26 into their functional locking positions, and a packoff retrieval ring 30 for interconnecting the energizing mandrel 18 and locking mandrel 28 to facilitate retrieval of the packoff by a pipe string (not shown) which has been connected to the mandrel 28.

The seal element 16 includes a base 32, an inner tubular portion 34 extending axially upward from the base 32, and an outer annular lip portion 36 that also extends axially upward from the base 32. The seal element 16 thus has a generally U-shaped cross-sectional configuration, with an annular cavity 38 open at its upper end. The seal element 16 has an inner frusto-conical surface 40 that tapers upwardly and inwardly at a slight angle (preferably 4 degrees) from the vertical, and on that surface 40 are a plurality (preferably three) of annular sealing ridges 42 of radiused cross-sectional configuration. The hanger 14 has a complementary tapered external sealing surface 44 against which the sealing ridges 42 bear to establish a metal-to-metal seal between the hanger and the seal element. The lip portion 36 of the seal element 16 also has a plurality (preferably 2) of annular sealing ridges 46 of radiused cross-sectional configuration and these ridges 46 bear against (FIGS. 2-6) an adjacent inner cylindrical sealing surface 48 of the wellhead housing 12 to provide a metal-to-metal seal between the housing and the seal element. Preferably the outside diameter of the seal element base 32 is larger than the diameter of the sealing ridges 46 so that when the packoff 10 is being run downhole the ridges 46 are protected. Likewise, the diameter of the lowest ridge 46 is larger than that of the upper ridge (or ridges) 46 for the same reason.

The outer surface 50 of the seal element tubular portion 34 is cylindrical, and the inner surface 52 of the seal element lip 36 is frusto-conical and tapers upwardly and outwardly from the vertical at an angle (preferably seven degrees) slightly greater than that of the seal surface 40. Thus the cavity 38 has an inner cylindrical periphery and an outer frusto-conical periphery which, as will be explained later, results in an improved seal energizing procedure. The upper end of an axial extension 54 of the seal element tubular portion 34 has a plurality of circumferentially spaced radial holes 56 into which extend shear pins 20 to releasably connect the seal element 16 to its energizing mandrel 18. Below its upper end the extension 54 has a reduced diameter outer surface 58 around which the seal retrieval ring 22 resides.

The seal energizing mandrel 18 includes a lower end portion 60 with a cylindrical inner surface 62 and a frusto-conical outer surface 64 that tapers upwardly and outwardly at an angle (preferably seven degrees) greater than that of the hanger sealing surface 44. As the mandrel 18 descends into the annular cavity 38 of the seal element 16 (FIGS. 2-5) during the packoff setting procedure the mandrel surface 64 forces the seal lip 36 outwardly against the wellhead housing 12. This downward movement of the mandrel 18 also effects downward movement of the seal element until that element lands (FIG. 3) on an upwardly facing annular stop shoulder 66 on the casing hanger 14, and increases the sealing force or "squeeze" exerted on the seal element's inner sealing ridges 42. A semi-circular annular undercut or groove 68 in the mandrel surface 62 functions to increase the ability of the mandrel to flex inwardly, and thus store energy, during its descent, and thus stored energy is utilized if pressure below the seal causes the wellhead to expand and consequently reduce the contact force at the outer sealing ridges 46.

The locking mandrel 28 has an external annular recess 70 that accommodates the wellhead lockdown ring 26 in its inwardly-biased contracted condition (FIGS. 1 and 2) while the packoff 10 is being run into the wellhead housing 12. The upper end 72 of the recess 70 tapers upwardly and outwardly to establish a cam surface that cooperates with a complementary annular surface 74 on the lockdown ring 26 to expand the ring into an internal groove 76 in the wellhead housing 12 as the mandrel 28 and the mandrel 18 descend from their FIG. 2 positions to their FIG. 3 positions. An outer cylindrical surface 78 on the mandrel 28 functions to maintain the ring 26 in its final functional position (FIG. 5) in the groove 76, whereby the packoff 10 is locked to the wellhead housing 12. The lower end of the mandrel 28 has an inward and upward tapering annular cam surface 80 that cooperates with a complementary cam surface 82 on the hanger lockdown ring 24 to contract the ring 24 from its expanded condition (FIG. 2) into an annular groove 84 in the hanger 14 as the mandrel descends (FIGS. 3-5), and an inner cylindrical surface 86 on the mandrel 28 maintains the ring 24 in its final functional position (FIG. 5) to lock the packoff 10 to the hanger 14. Thus, when both rings 24, 26 and the mandrel 28 are in their FIG. 5 positions the packoff 10 and the hanger 14 are secured to the wellhead housing 12, thereby preventing them from blowing out of the housing if pressure builds up in the well.

PACKOFF RUNNING PROCEDURE

The packoff 10 is connected to a running tool (not shown) by a lock pins in the tool that extend out into a groove 88 in the upper inner surface of the locking mandrel 28, with elements of the packoff in their relative positions as seen in FIG. 1. The running tool with the packoff is then lowered by means of a drill or other pipe string (not shown) through the drilling riser and blowout preventer stack (neither shown) until the seal element 16 lands on the tapered sealing surface 44 of the casing hanger 14. Support of the drill string is then released, transferring the weight of the string and the running tool through a tool sleeve 90 (only lower end portion shown) onto the energizing mandrel 18, either through the packoff's wellhead lockdown ring 26 (FIGS. 1-5) or directly (FIG. 6), and thence through the shear pins 20 onto the seal element 16, as indicated by the arrows in FIG. 1.

At first the seal element 16 moves downward on the hanger sealing surface 44, expanding and storing energy as such motion occurs. In this phase all the force is being utilized to push the seal element 16 downwards, creating contact force between the hanger sealing surface 44 and the seal element inner sealing ridges 42 that form the three initial sealing sites. When resistance to this downward movement of the seal element 16 exceeds the strength of the shear pins 20 these pins shear, allowing the energizing mandrel 18 to move downwards with respect to the seal element. During this downward movement of the mandrel two events occur: (1) the seal element lip 36 is tilted and pushed outwards into contact with the wellhead housing sealing surface 48 to establish an initial seal between that surface and the lip sealing ridges 46, and (2) the seal element moves further downwards and outwards on the hanger sealing surface 44, resulting in increased contact force between that hanger surface and the seal element inner sealing ridges 42. As the seal between the lip 36 and the wellhead housing is being established the lower end portion or nose 60 of the energizing mandrel 18 is being forced inward to create a pre-load that maintains this seal when the wellhead housing expands. At this stage, although the seal element 16 has not landed on the hanger shoulder 66 or been completely energized, it has sequentially formed a low pressure metal-to-metal seal in the annulus first with the hanger 14 and then with the wellhead housing 12.

The blowout preventer pipe rams are then closed around the drill pipe above the running tool, and pressure is applied below the rams. This pressurizes the fluid in the seal element annular cavity 38, resulting in downward movement of the seal element until it lands (bottoms out) on the hanger shoulder 66. This pressure also pushes the seal element lip 36 more tightly against the wellhead housing 12, and the seal element tubular portion 34 more tightly against the casing hanger 14, increasing the strength of the metal-to-metal seals at those interfaces.

The pressure exerted on top of the running tool by this procedure is converted into a downward mechanical force that is transferred through the tool's sleeve 90 onto the top of the wellhead lockdown ring 26. The pressure on the top of the tool also forces the main body of the tool to move downward and land on top of the locking mandrel 28 where this downward force is transferred onto and through the mandrel 28, the wellhead lockdown ring 26 and the energizing mandrel 18 to the seal element 16. All the packoff components except the seal element move downward until the wellhead lockdown ring 26 is aligned with the wellhead housing groove 76, at which time the ring is forced to expand into the groove by continued downward movement of the locking mandrel 28.

As the locking mandrel 28 continues to move downward its lower end tapered surface 80 contacts and cooperates with the tapered surface 82 on the hanger lock ring 24 to force this ring to contract into the hanger groove 84. The vertical forces acting on the mandrels 28, 18 cause their further downward movement, and that movement of the energizing mandrel 18 results in further energization of the seal element 16. When the locking mandrel 28 lands on top of the hanger 14 (FIG. 5) the packoff 10 is fully installed and locked to both wellhead housing 12 and hanger 14, and the metal-to-metal seal between these well components is fully energized.

PACKOFF RETRIEVAL PROCEDURE

Figure 5:
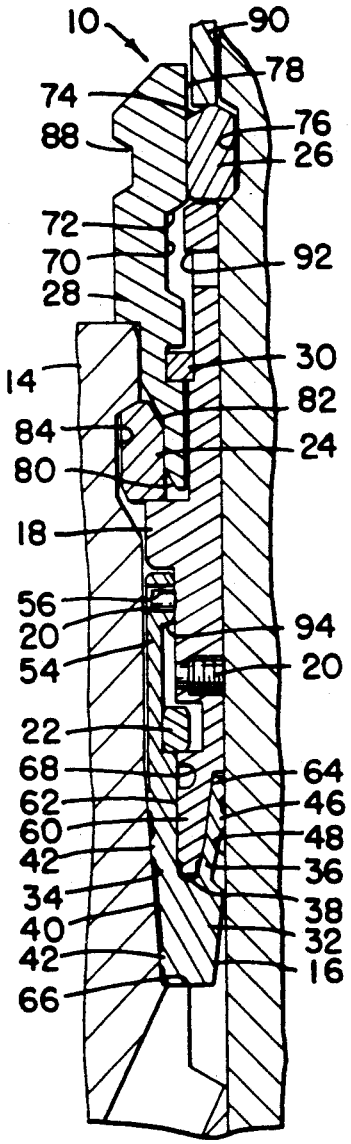
FIG. 5 is a view like and subsequent to FIG. 4, showing the final installed position of the packoff assembly elements upon completion of the running procedure.
Figure 6:
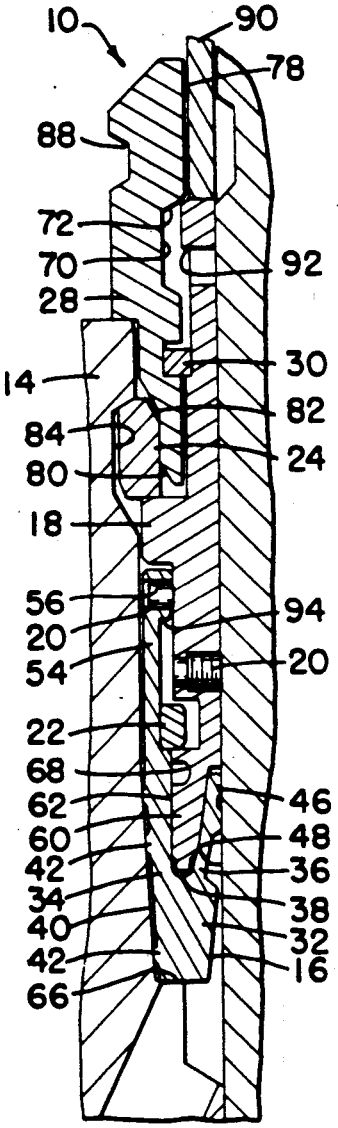
FIG. 6 is a view like FIG. 5, showing the final installed position of the packoff assembly without a wellhead lockdown ring.

To retrieve the packoff 10 from its position shown in FIGS. 5 and 6, a retrieval tool (not shown) with spring-loaded keys or a split ring is run on a pipe string and landed on the casing hanger 14, at which point the keys or ring pop out into the locking mandrel groove 88. The tool is then picked straight up (no rotation required), producing the following sequential events: (1) the locking mandrel 28 moves upward; (2) the hanger lockdown ring 24 expands out of the hanger groove 84 onto the energizing mandrel 18; (3) the wellhead lockdown ring 26 contracts out of the wellhead housing groove 76 and into the annular recess 70 of the locking mandrel 28; (4) the packoff retrieval ring 30 slides up until it contacts the downward facing annular shoulder 92 of the energizing mandrel 18 and then lifts that mandrel; and (5) the seal retrieval ring 22 slides up with the energizing mandrel until the ring contacts the annular downward facing shoulder 94 on the seal element extension 54 and then lifts the seal element.

The seal element 16 is truly pressure energized from the top, that is the higher the pressure above it the greater is the contact force at the surfaces of the sealing ridges, and consequently the higher the pressure controlling capacity. During the initial phase of seal energization, i.e. when the seal element is still shear pinned to the energizing mandrel, all the downward force is utilized in expanding and energizing only the inner sealing ridges 42 against the hanger sealing surface 44, and this feature holds true during the later stage of the energization process. When pressure is applied on top of the running tool it pushes the seal element down until it bottoms out on the hanger, and during this phase the major portion of the downward force is utilized to expand the seal element and further energize its inner sealing ridges. During the final phase of seal element energization, the major portion of the downward force is used for further energizing the outer sealing ridges.

When the seal element 16 is pressurized from beneath it will move up only after the initial preload is overcome. The packoff is designed to minimize seal element movement, but if such movement occurs the seal element lip 36 is squeezed into an increasingly smaller annular space between the nose of the energizing mandrel and the wellhead housing, whereby the contact force at its outer sealing ridges 46, and thus its pressure controlling capacity, are increased.

When pressure below the hanger 14 pushes it upwards the load is transferred through the wellhead lockdown ring 26 to the wellhead housing 12 in a unique way. The hanger shoulder 66 pushes the seal element 16 upwards, resulting in establishing contact between the seal element and the energizing mandrel 18 simultaneously at two locations, namely at the bottom of the mandrel nose 60 and at the top of the seal retrieval ring 22 against the bottom of which the seal element bears. This twin load path increases the magnitude of upward force the seal element can withstand without adversely affecting its sealing capability.

Although the best mode contemplated for carrying out the present invention has been herein shown and described, it will be apparent that modification and variation may be made without departing from what is regarded to be the subject matter of the invention.

What is claimed is:

1. An annular packoff for establishing a metal-to-metal seal in the annulus between a wellhead housing and a casing hanger, the packoff comprising an assembly including:

a) an annular metallic seal element adapted for non-rotational sequential setting against said casing hanger and said wellhead housing, said seal element including an annular base, an inner tubular portion extending axially from said base, an outer annular lip portion likewise extending axially from said base, at least one annular sealing ridge on said tubular portion for metal-to-metal contact with a casing hanger, and at least one annular sealing ridge on said lip portion for metal-to-metal contact with a wellhead housing;

b) an energizing mandrel for sequentially energizing the seal element into metal-to-metal sealing engagement first with said casing hanger and then with said wellhead housing in response to axial movement of said mandrel with respect to said hanger and said housing;

c) means releasably connecting the seal element to the energizing mandrel;

d) an annular locking mandrel;

e) means for slidably connecting the locking mandrel to the energizing mandrel; and f) means for releasably locking the energizing mandrel to the casing hanger in response to axial movement of the locking mandrel with respect to said energizing mandrel.

2. A packoff assembly according to claim 1 including means for releasably locking the energizing mandrel to the wellhead housing in response to axial movement of the locking mandrel with respect to said energizing mandrel.

3. A packoff assembly according to claim 2 wherein axial movement of the locking mandrel sequentially locks the energizing mandrel to the wellhead housing and the casing hanger.

4. A packoff assembly according to claim 1 including means slidably interconnecting the seal element and the energizing mandrel to facilitate retrieval of said seal element with said energizing mandrel as an assembly from the wellhead housing.

5. A packoff assembly according to claim 1 wherein the tubular portion and the lip portion both include a plurality of annular sealing ridges.

6. A packoff assembly according to claim 5 wherein the sealing ridges have radiused cross-sectional configurations.

7. A packoff assembly according to claim 6 wherein the tubular portion has three sealing ridges and the lip portion has two sealing ridges.

8. A packoff assembly according to claim 1 wherein the tubular portion and the lip portion form an annular cavity with an open upper end, and wherein the boundaries of said cavity include a cylindrical surface on said tubular portion and a frusto-conical surface on said lip portion.

9. A packoff assembly according to claim 1 wherein the energizing mandrel includes a lower end portion with an inner cylindrical surface and an outer frusto-conical surface.

10. An annular packoff for establishing a metal-to-metal seal in the annulus between a wellhead housing and a casing hanger, said packoff comprising an assembly including:

a) an annular metallic seal element adapted for non-rotational sequential setting against said casing hanger and said wellhead housing, said seal element having an inner frusto-conical surface with at least one annular sealing ridge for sealingly contacting a frusto-conical sealing surface of said casing hanger;

b) an annular energizing mandrel for sequentially energizing the seal element into metal-to-metal sealing engagement first with said casing hanger and then with said wellhead housing in response to axial movement of said energizing mandrel with respect to said hanger and said housing, said energizing mandrel including a lower end portion with an inner cylindrical surface and an outer frusto-conical surface, said mandrel frusto-conical surface having an angular taper greater than that of said casing hanger frusto-conical surface;

c) means releasably connecting the seal element to the energizing mandrel;

d) an annular locking mandrel;

e) means for slidably connecting the locking mandrel to the energizing mandrel; and f) means for releasably locking the energizing mandrel to the casing hanger in response to axial movement of the locking mandrel with respect to said energizing mandrel.

* * * * *